US006146258A

United States Patent [19]

Cottam

[11] Patent Number: 6,146,258

[45] Date of Patent: Nov. 14, 2000

[54] ABRASIVE CLEANING APPARATUS

[76] Inventor: Spencer D. Cottam, 7848 S. Willowcrest Cir., Salt Lake City, Utah 84121-5721

[21] Appl. No.: 09/048,474

[22] Filed: Mar. 26, 1998

[51] Int. Cl.[7] ..... B24B 23/00

[52] U.S. Cl. ..... 451/344; 451/109; 29/81.12

[58] Field of Search ..... 451/109, 344; 29/81.12; 15/179, 198, 186

[56] References Cited

U.S. PATENT DOCUMENTS

| | | | |
|---|---|---|---|
| 1,786,096 | 12/1930 | Thielmann | 144/115 |
| 3,246,378 | 4/1966 | Beckers | 15/179 |
| 4,106,193 | 8/1978 | Fisher et al. | 30/172 |
| 4,531,253 | 7/1985 | Cottam . | |
| 4,783,875 | 11/1988 | Cottam | 15/236.01 |
| 5,311,652 | 5/1994 | McConkey et al. | 29/81.04 |

OTHER PUBLICATIONS

A color photocopy of a photograph of a prior art cleaning apparatus manufactured by Comax, Inc., located at 7848 Willowcrest Circle, Salt Lake City, UT 84121.

*Primary Examiner*—David A. Scherbel

*Assistant Examiner*—Shantese McDonald

*Attorney, Agent, or Firm*—Akin, Gump, Strauss, Hauer & Feld, L.L.P.

[57] ABSTRACT

An abrasive cleaning apparatus has an integral drum formed of inner and outer layers of resilient material and a rigid layer in between. Holes are formed through the drum in a spiral pattern around the drum. A wire is engaged in each hole, the wire having opposing ends and three bends. One end of the wire is inside the drum with an adjacent portion lying circumferentially on an inner surface of the drum. A portion of the wire outside the drum is aligned in an opposite circumferential direction as the portion of the wire inside the drum. A retaining cylinder sandwiches the end inside the drum between itself and an inside surface of the drum, holding the wire stable. The end of the wire inside the drum is in close proximity to ends of adjacent wires, which inhibits rotation of a wire in its hole in the drum.

19 Claims, 2 Drawing Sheets

FIG.1
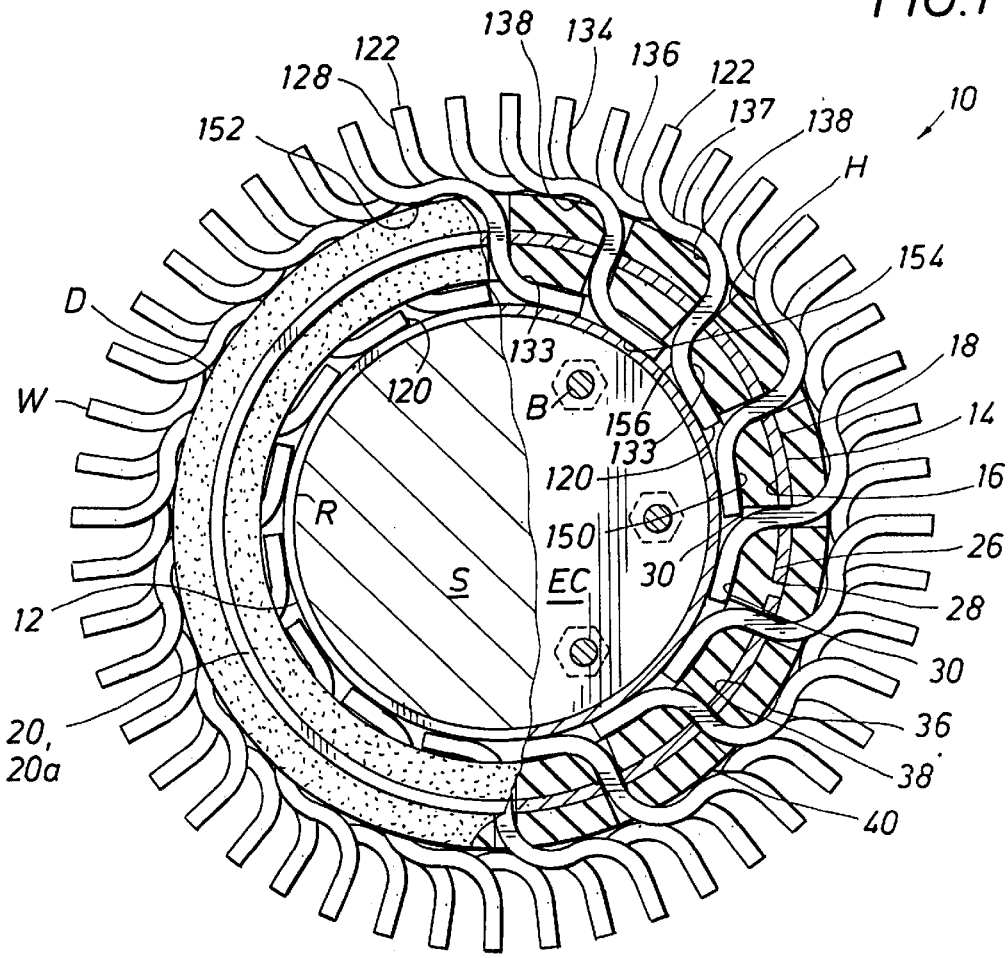
FIG.5
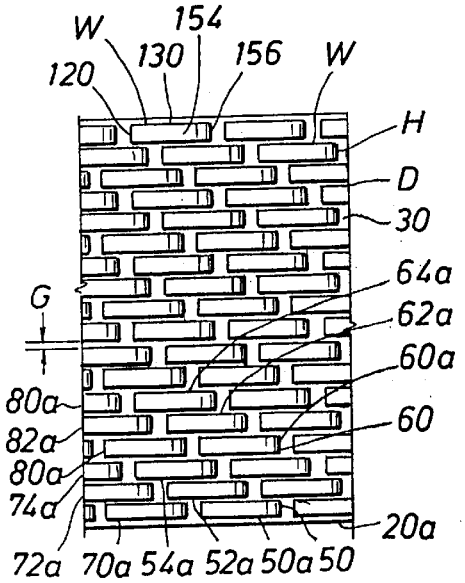
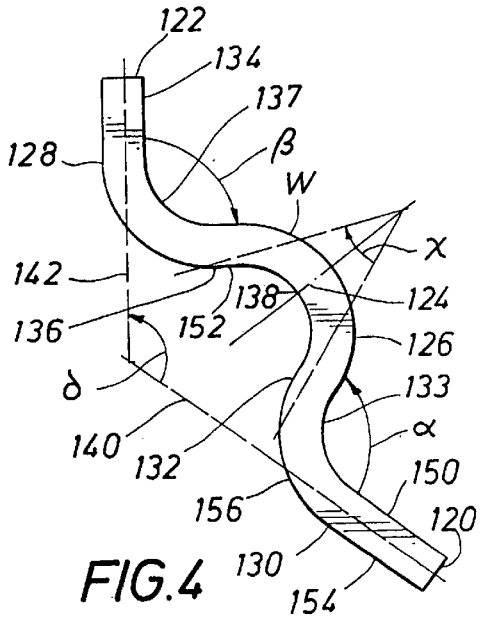
FIG.4

ABRASIVE CLEANING APPARATUS

CROSS-REFERENCE TO RELATED APPLICATIONS

None.

STATEMENT REGARDING FEDERALLY SPONSORED RESEARCH

Not applicable.

BACKGROUND OF THE INVENTION

1. Field of the Invention

This invention pertains to cleaning devices, and more particularly to a rotary abrasive cleaning apparatus.

2. Description of the Related Art

In the past, a rotary abrasive cleaning apparatus has been used including a cylindrical drum which had a metal core with rubber layers inside and outside the metal core. Holes were made in the drum, and substantially U-shaped staples were pushed through the holes from the inside toward the outside. Each U-shaped staple was made from a single piece of wire bent into the substantially U-shape and then bent again to form two more bends. Thus, the bending of the wire required two manufacturing steps.

Since the wire was a U-shaped staple, two wire tips had to be aligned with two holes. Further, since the staple was pushed from the inside towards the outside, it was difficult to see the alignment of the wire tips with the holes, and it was difficult to push the staple from the inside toward the outside. The inside diameter of the drum had a minimum limit of the length of the staple, so it was not feasible to make drums with an internal diameter smaller than the length of the staple. The crowns of the staples required considerable space inside the drum, which limited the number of staples and wire tips that a drum could accommodate. For a six-inch diameter rotary cleaning apparatus, the number of axially aligned rows around the circumference of the cleaning apparatus was limited to about 36.

The U-shaped staples were supported by the rubber layer inside the metal core, but since the wires were U-shaped, the support was limited to the amount of rubber between the legs of the staple. As the rotary cleaning apparatus was used, the rubber became worn, and the staples became loose. When the staples became loose, the tips of the wires were not stable which sometimes lead to a tip of a wire being pushed sideways into the path made by another tip, which caused grooving in the surface that was being cleaned. Consequently, the surface was not cleaned uniformly. Although the prior art rotary cleaning apparatus was a good tool for cleaning off rust, scale or paint from a surface being prepared for painting or coating, the apparatus had its limitations. Manufacturing was somewhat expensive; the density of wire tips on the drum was limited; the U-shaped staple was difficult to insert into the drum from the inside toward the outside; and the support for the U-shaped staple was limited since the amount of the staple in contact with the rubber was limited to the crown portion of the staple.

SUMMARY OF THE INVENTION

The present invention on the other hand provides a rotary cleaning apparatus that is simpler to manufacture and assemble and has well-supported, stable wires configured in a high-density pattern. The cleaning apparatus includes a cylindricalshaped drum, and the drum has an inner rigid core, a resilient layer inside the rigid core, and a resilient layer outside the rigid core. The drum has holes formed radially through the outside layer, the rigid core and the inside layer. The holes are preferably drilled in a uniform pattern forming a set of parallel spiral lines of holes around the drum. Rows of holes in an axial direction are separated by a space having the width of at least two holes, where an adjacent row has one hole aligned with the space, and a row once removed has another hole aligned with the space.

The apparatus further includes a plurality of wires cut to a desired length, one for each hole, the wires preferably having a square cross-section. Each wire is preferably formed with three bends, a first bend proximate to a first end, a second bend proximate to an opposing second end, and a third bend in between the first and second bends. The first and second bends are curved in the same direction, while the third bend is curved in an opposite direction. In a preferred embodiment, the length of wire between the first bend and the first end lies on an inside surface of the inside resilient layer, and the second bend and second end are outside the outside resilient layer.

The shape of the wire and the pattern of the holes in the drum allow for the wires to be densely packed on the drum, which improves cleaning efficiency over a prior art cleaning apparatus, which has a lower density of wires. In a preferred embodiment, the first end of the wire, which is on the inside of the drum, is sandwiched between adjacent first ends of wire to restrict lateral movement, which inhibits a wire from rotating within its hole.

Thus, the wire is very stable and is preferably held in that position by a retaining cylinder that fits within the drum and sandwiches the first end of each wire between the retaining cylinder and the inside surface of the inside resilient layer. The abrasive cleaning apparatus of the present invention is highly effective at cleaning a surface because tips of the wires are densely packed, uniformly spaced and stable, which results not only in highly productive cleaning rates but also in a surface that is uniformly cleaned.

BRIEF DESCRIPTION OF THE DRAWINGS

A better understanding of the present invention can be obtained when the following detailed description of the preferred embodiment is considered in conjunction with the following drawings, in which:

FIG. 1 is an elevational view of an abrasive cleaning apparatus according to the present invention with a partial cut away to show wires passing through a drum;

FIG. 4 is a plan view of a wire, according to the present invention; and

FIG. 5 is a plan view of a section of the inside of the cleaning apparatus of FIG. 1, with the retaining cylinder removed to show the wire layout inside the drum.

DETAILED DESCRIPTION OF THE INVENTION

Figure 2:
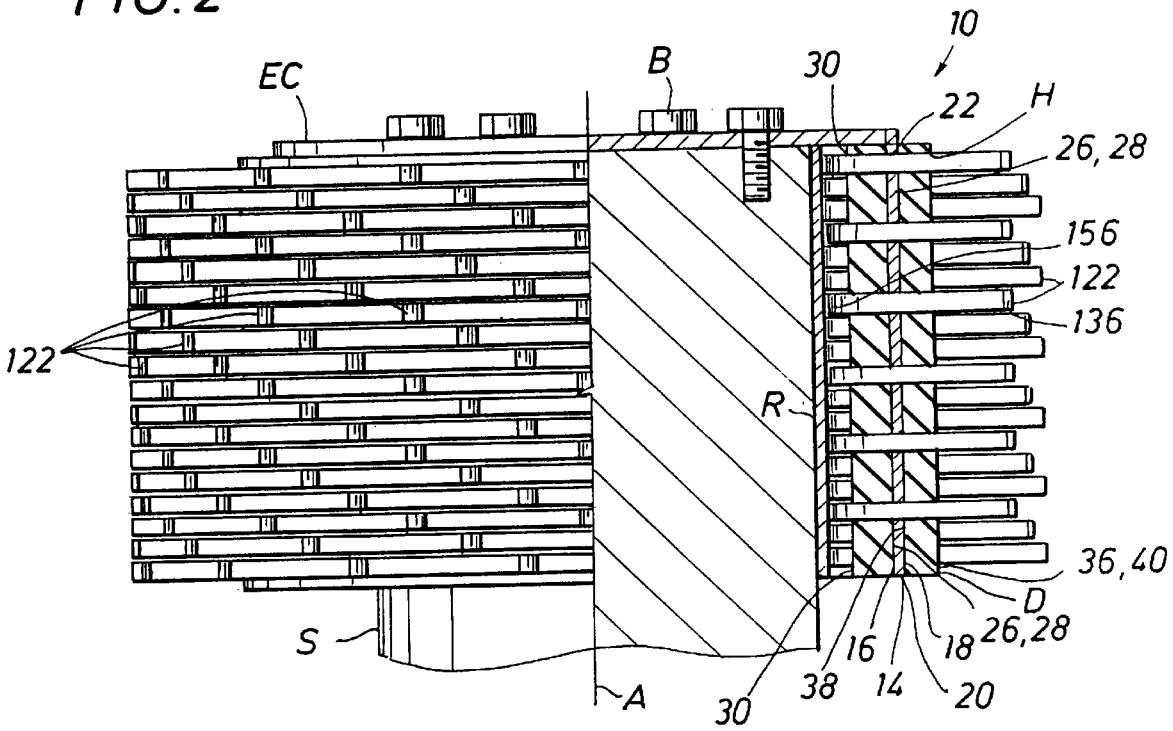
FIG. 2 is a plan view of the abrasive cleaning apparatus with a portion of the drum cut out to show wires passing through the drum.
Figure 3:
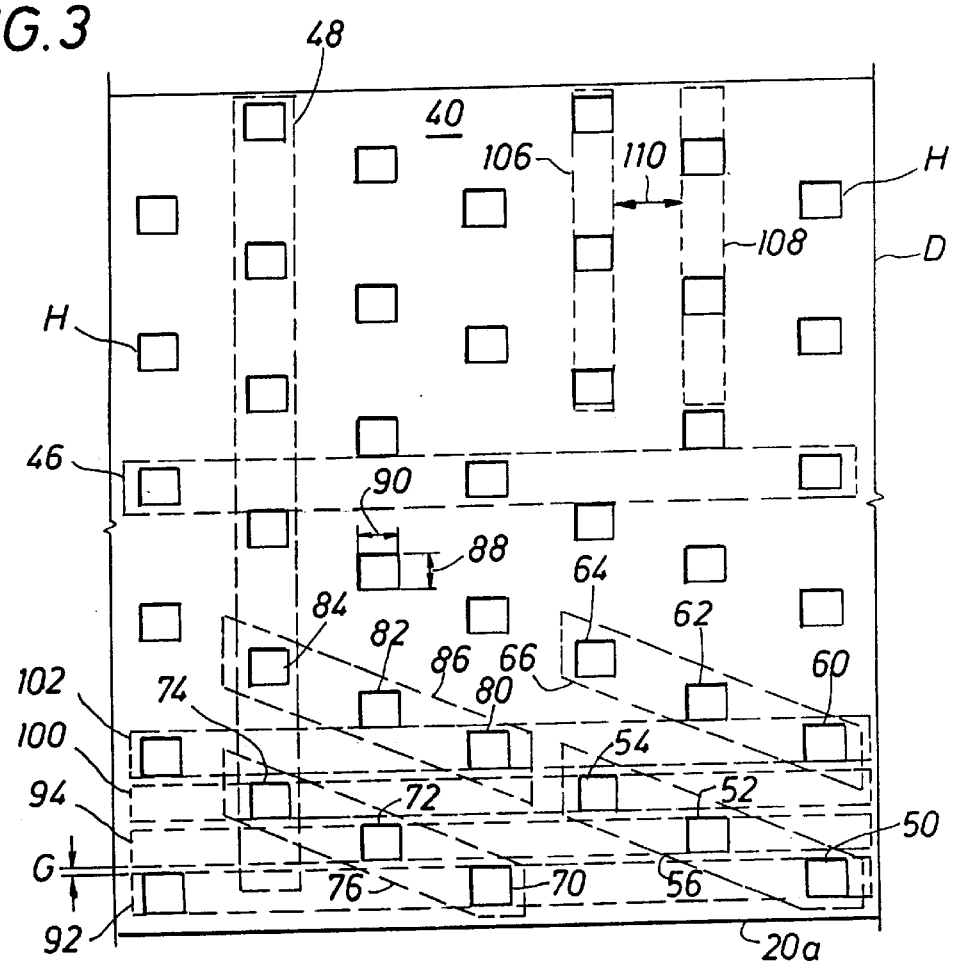
FIG. 3 is a plan view of the hole pattern on the drum.

With reference to the FIGS. 1 and 2, an abrasive cleaning apparatus 10 has an integral drum D, and drum D has a plurality of opening or holes H that form a pattern, as illustrated in FIG. 3. Each hole H receives a wire W, and wire W has three bends (FIG. 4). One end of wire W lies on the inside of drum D, and the other end is outside drum D.

A retaining cylinder R sandwiches an end portion of wire W between an outside surface 12 of itself and an inner surface of drum D. An end cap EC is secured to drum D, and a shaft S receives bolts B for fastening drum D to shaft S. Shaft S is connected to a driver (not shown), such as an electric motor, which rotates shaft S in a clockwise direction as viewed in FIG. 1. As drum D rotates, wires W engage and abrade a surface to be cleaned. The shape of wire W allows substantial contact between wire W and an inside surface of drum D and thus provides greater support for wire W than has been achieved in the prior art. Since wire W is well supported, there is little wear on drum D at the contact points between wire W and drum D.

Drum D has a rigid core 14, which can be fabricated from, for example, a carbon steel or a stainless steel pipe. Rigid core 14 has an inner surface 16 and an outer surface 18. Rigid core 14 further has an inside edge 20 and an outside edge 22. A resilient inner cylinder 26 having an outer surface 28 and an inner surface 30 is adjacent to inner surface 16 of rigid core 14. Outer surface 28 of inner resilient cylinder 26 is in tight-fitting engagement with inner surface 16 of rigid core 14 either by bonding or by frictional engagement.

A resilient outer cylinder 36 having an inner surface 38 and an outer surface 40 is adjacent to outer surface 18 of rigid core 14. Inner surface 38 is in tight-fitting engagement with outer surface 18 of rigid core 14 either by bonding or by frictional engagement. Inner cylinder 26, rigid core 14 and outer cylinder 36 fit sufficiently tightly together so as to form an integral piece, namely drum D. Inner resilient cylinder 26 and outer resilient cylinder 36 are preferably rubber having a hardness ranging between 30 and 60 durometer. Rigid core 14 provides a rigid support for wire W, while inner cylinder 26 and outer cylinder 36 provide a resilient support for wire W. The rigid support provided by rigid core 14 provides strength and durability for abrasive cleaning apparatus 10.

Abrasive cleaning apparatus 10 can be used to clean a variety of surfaces, many of which will be uneven. For example, cleaning apparatus 10 can be used to remove paint or rust from a surface being prepared for a coating of paint. When wire W encounters a protrusion on the surface, a force is exerted on wire W. This force is absorbed partly by flexing wire W, but the remainder of the force is absorbed by resilient outer resilient cylinder 36 and resilient inner cylinder 26. By having some resiliency in outer resilient cylinder 36 and inner resilient cylinder 26, wire W can flex less than would otherwise be required when a protrusion is encountered, which allows wire W to have a longer life before failure than would otherwise be the case.

With reference to FIG. 3, holes H are drilled in drum D to form columns 46 and rows 48. Holes H are typically drilled radially toward the center of drum D, but can be drilled off-center to facilitate manufacturing assembly. If holes H are not directed toward the radial center of drum D wire W may have a different shape. Holes H are round holes drilled large enough to provide clearance for a wire having a square cross-section to pass through. However, as the hole is drilled through drum D the resilient rubber layers stretch around the drill, which results in holes through the resilient layers that are smaller than the diameter of the drill bit that was used to drill the hole. When a wire W is inserted in a hole H, the resilient layers must stretch to accommodate the wire. Thus, wires W are held firmly in place by resilient inner and outer cylinders 26 and 36, respectively.

Columns 46 are parallel with the circumference of drum D, and rows 48 are perpendicular to columns 46. Shaft S and drum D have a common axis A, and rows 48 are parallel with axis A. Thus, columns 46 can be described as circumferential, while rows 48 can be described as axial. A beginning hole 50, a middle hole 52 and an ending hole 54 form a set of holes 56. Similarly, holes 60, 62 and 64 form a set 66; holes 70, 72 and 74 form a set 76; and holes 80, 82 and 84 form a set 86. Drum D has an edge 20*a*, and hole 50 is adjacent to edge 20*a*. Sets 56, 66, 76 and 86 are identical and repeat to form a pattern. Wire W preferably has a square cross-section to make attachment of regular carbide tips easier, but wires W can have other crosssectional shapes such as that of a rectangle or a circle.

Holes 50 and 70 are in a column 92, and holes 52 and 72 are in an adjacent column 94. Adjacent columns 92 and 94 are separated by a gap G. Adjacent columns 92 and 94 are typical of all adjacent columns, and gap G is less than the diameter of hole H, and gap G is preferably less than about one-half of the diameter of hole H. For a typical drum, gap G ranges between about 0.002 inches and about 0.005 inches. Holes 54 and 74 form a column 100, and holes 60 and 80 form a column 102. Columns 94 and 100 fit between columns 92 and 102. Holes 50 and 60 are separated by at least the width of holes 52 and 54. Further, holes 50 and 60 are separated by columns 94 and 100 plus any gap G that is between the columns. Adjacent rows 106 and 108 on the other hand are separated by a gap 110, and gap 110 is greater than gap G between adjacent columns. Gap 110 between adjacent rows 106 and 108 is slightly greater than a length of wire W lying on surface 30 of resilient inner cylinder 26, as will become apparent from the discussion with reference to FIG. 5.

Cleaning apparatus 10 is rotated, and the wires scratch and scrap a surface to be cleaned, which removes rust, scale, old paint or other materials from the surface. Gap G is minimized so that the lateral or axial space between wires among the rows is minimal. The density of wires is thus high so that wires clean the surface uniformly.

Sets 56, 66, 76 and 86 form a pattern that allows for a high density of wires, which improves the cleaning effectiveness of cleaning apparatus 10. Sets 56 and 86 are placed end-to-end. A straight line can be placed through holes 50, 52, 54, 80, 82 and 84, and that line can be continued in a spiral or helical pattern or row around the drum. Thus the sets 56, 66, 76 and 86 indicate that the holes H are placed in parallel, spiral or helical lines or rows around drum D.

In another sense the pattern of holes can be thought of as having a beginning row, a middle row, and an ending row, where each of the rows has an edge hole. The edge hole is the hole in the row closest to an inside edge of the drum. Holes 50, 52 and 54 are thus edge holes, since each of these holes is the closest within its axial row to inside edge 20A of Drum D. Hole 52 is spaced from 20A by the width of hole 50 plus gap G. Hole 54 is spaced from edge 20A by the width of hole 50 plus the width of hole 52 plus any gap G between these holes. Further, holes 50 and 70 can be described as beginning edge holes for parallel spiral or helical rows around drum D. In this regard a middle row being axial and having hole 52 as an edge hole and an ending row being axial and having hole 54 as an edge hole together separate the axial rows having holes 50 and 70 as beginning edge holes.

Turning now to FIG. 4, wire W has a first end 120 and an opposing second end 122. Second end 122 is typically hardened, such as by receiving a carbide tip. Wire W has a midpoint 124, which separates wire W into a first half 126 and a second half 128. First half 126 and second half 128 are relatively symmetrical. First half 126 has an end portion 130 and a middle portion 132, and an angle α is formed between end portion 130 and middle portion 132 and measures the angle of a first bend 133. Angle α ranges between 75 and 135 degrees, preferably between 85 and 125 degrees, and more preferably between 95 and 115 degrees, and angle α is typically about 105 degrees. Similarly, second half 128 has an end portion 134 and a middle portion 136. An angle β is formed between end portion 134 and middle portion 136, measuring the angle of a second bend 137. Angle β ranges between 65 and 125 degrees, preferably between 75 and 115 degrees, and more preferably between 85 and 105 degrees, and angle β is typically about 95 degrees.

First and second bends 133 and 137, respectively, in wire W are curved in the same direction, but wire W has a third bend 138, which is curved in an opposite direction. The third bend has an angle χ that ranges between 30 and 80 degrees. Angle χ is preferably between 40 and 70 degrees, more preferably between 75 and 95 degrees, and angle χ is typically about 75 degrees. Portions 130 and 134 have centerlines 140 and 142, respectfully, which intersect at an angle δ. Angle δ ranges between 90 and 155 degrees, preferably between 100 and 145 degrees and more preferably between 110 and 135 degrees, with about 125 degrees being typical. Angle δ will increase with smaller diameter drums and decrease with larger diameter drums.

The bends in wire W are two dimensional, and thus, a centerline through the full length of wire w from first end 120 to opposing second end 122 lies within a plane, the angles α, β and χ not having a third dimensional component. However, it is desirable for certain applications to provide a wire with a side bend for cleaning to the edge of an inside corner, but such a wire is not shown. Although also not shown, it is possible to make the length of end portion 134 of wires W progressively longer from one edge of drum D to the other edge, which also allows the tool to reach into the edge of an inside corner. Longer lengths of wires W can be accomplished by finished grinding of the apparatus on a taper.

Wire W has a first surface 150 on end portion 130 adjacent to first end 120. Wire W also has a surface 152 on middle portion 136 of second half 128, and a surface 154 opposes surface 150 on end portion 130 of wire W adjacent to first end 120. A bend surface 156 is opposite angle χ and between end portion 130 and middle portion 132. First end 120 is pushed through hole H until surface 150 is in contact with inside surface 30 of inner resilient cylinder 26. Middle portion 132 of first half 126 of wire W is engaged in hole H. Midpoint 124 of wire W is outside hole H, and surface 152 of wire W is proximate to outer surface 40 of outer resilient cylinder 36.

Typically, surface 152 of wire W is not in contact with outer surface 40 of outer resilient cylinder 36. However, when a great deal of force is applied to second end 122 of wire W, wire W flexes until surface 152 contacts outer surface 40 of outer resilient cylinder 36. Since outer resilient cylinder 36 is resilient, it flexes to absorb a portion of the force applied to second end 122. In addition, inner surface 30 of inner resilient cylinder 26 flexes as surface 150 of wire W compresses inner resilient cylinder 26 between surface 150 and inner surface 16 of rigid core 14. Thus, when force is exerted on wire W, both inner resilient cylinder 26 and outer resilient cylinder 36 absorb a portion of the force, which prolongs the life of wire W as it does not have to flex and bend as much as it otherwise would if drum D were not resilient.

The distance between surface 152 of wire W and outer surface 40 of resilient outer cylinder 36 depends on the angles bent into wire W. By making angle α smaller, the distance between surface 152 and surface 40 is increased. Also, by making angle α smaller, the distance is decreased between inner surface 30 of resilient inner cylinder 26 and surface 150 on wire W. The smaller the distance between wire W and surface 40 and wire W and surface 30, the less wire W will flex, which makes cleaning apparatus 10 stiffer. A stiffer tool is more aggressive and leaves a coarser pattern on the surface being cleaned. Greater space between wire W and either surface 30 or surface 40 allows wire W to flex or rotate more in hole H, which results in cleaning apparatus 10 being less stiff When the cleaning apparatus is less stiff a finer pattern is left on the surface being cleaned. By making slight changes in α, β or χ, cleaning apparatus 10 can be built with varying degrees of stiffness, which provides different cleaning patterns that can be adapted for particular applications.

Turning now to FIG. 5, a typical wire W is shown protruding through a typical hole H as viewed from inside of drum D with retaining cylinder R removed. End portion 120 of wire W extends circumferentially from hole H within drum D on inner surface 30 of inner resilient cylinder 26. End portion 130 is within the interior space defined by inner surface 30 of inner cylinder 26. Surface 154 is exposed since retaining cylinder R is not shown. Bend surface 156 is at an end of end portion 130 that opposes first end 120. Bend surface 156 is partly in contact with hole H. A wire 50*a* is engaged with hole 50 in drum D. Similarly, wires 52*a*, 54*a*, 60*a*, 62*a*, 64*a*, 70*a*, 72*a*, 74*a*, 80*a*, 82*a*, and 84*a* are engaged with holes 52, 54, 60, 62, 64, 70, 72, 74, 80, 82 and 84, respectively. As noted above with reference to FIG. 3, circumferentially adjacent holes are separated by gap 110. Gap 110 is approximately equal to and slightly greater than the length of end portion 130. Axial rows are placed as close together as possible while allowing circumferential space for end portion 130 to lie on inner surface 30. For a six-inch diameter drum with three-sixteenths inch diameter wire, the end portion is about three-fourths of an inch in length.

Lateral movement of end portion 130 of wire W is restricted because end portion 130 is sandwiched between adjacent end portions of wires W. The lateral movement of end portion 130 is restricted to gap G before contacting an adjacent end 130. For example, wire 52*a* lies between wires 54*a* and 70*a*. Thus, if an uneven protrusion is encountered on a surface being cleaned that tends to rotate wire 52*a*, rotational movement within hole 52 is limited because lateral movement of its end portion is restricted since end portion 130 will encounter either wire 54*a* or wire 70*a*, depending on the direction of rotation within hole 52. Also, wire W preferably has a square cross-section because this shape provides a greater bearing surface between end portions than would a round wire. These features are cooperative to limit rotational movement of wire W in hole H. If it is desired to further limit movement of the wires, retaining rings can be welded to the wires on both the inside and the outside of the drum.

Cleaning and abrasion on the cleaned surface is consequently more uniform because lateral movement of opposing second end 122 is minimal because first end 120 is restricted in its movement. In the prior art on the other hand, a wire had more lateral movement because it was not supported as well, which led to channeling and grooving for a coarser and less uniformly cleaned surface.

The pattern of holes H and the length of end portion 130 of wire W is coordinated so that each end portion 130, except those on the outer edges, is between adjacent bend portions 156. The lateral movement of wire W at the point indicated by bend surface 156 is relatively minimal, because wire W is in relatively tight-fitting engagement with hole H.

Abrasive cleaning apparatus 10 can be made by first cutting rigid core 14 from a piece of standard pipe of a desired diameter, such as 6-inch diameter pipe. End cap EC is welded onto rigid core 14, and holes are formed in end cap EC for pass-through of bolts B. Resilient inner cylinder 26 can be formed from hard rubber pipe, if available, or by cutting a sheet of flat rubber to a desired dimension and fitting it within inside surface 18 of rigid core 14 in a tight-fitting engagement. Outer surface 28 of resilient inner cylinder 26 is preferably bonded to inner surface 16 of rigid core 14. Likewise, resilient outer cylinder 36 is fitted to rigid core 14 by cutting a desired length of a preformed hard rubber pipe or by cutting a sheet to a desired dimension and wrapping it around outer surface 18 of rigid core 14. In either case inner surface 38 of resilient outer cylinder 36 is preferably bonded to outer surface 18 of rigid core 14. In this manner drum D is made an integral cylinder having the three layers, with the resilient inner cylinder 26 and resilient outer cylinder 36 each having a thickness of about 0.50 inches.

Holes are next drilled through drum D to provide the pattern described above and illustrated in FIG. 3. On a standard size drum, where rigid core 14 has an inside diameter of approximately five and three-eighths inches, rigid core 14 is cut to a length of twelve and one-quarter inches, which accommodates 22 columns per row. For a standard drum, 48 rows are punched with 22 columns per row for a total of 1,056 holes. Three-sixteenths of an inch square wire is used for wire W. Thus, holes H must be drilled to receive the three-sixteenths of an inch square wire in tight-fitting engagement. A plurality of wires, in this example 1,056 wires, are cut to a desired length, which for the standard drum described here is about three inches in length. The three bends described above are made in each wire, the bends being formed in a one-step process. A press having a mold which will yield a wire having the desired bends is used.

The present invention provides a significant advantage in the method of placing wires W in holes H of drum D. A wire is pushed through each hole from the outside of the drum towards the inside, passing one bend through the hole and leaving two bends external of outer surface 40 of resilient outer cylinder 36. It is much easier to push a wire from the outside of the drum D towards the inside than from the inside toward the outside because force is more easily applied and various tools can be used for mechanical advantage. In the prior art two bends had to be pushed through the holes, but in the present invention only the bend having the angle $\alpha$ is pushed through hole H. The wires are oriented so that when a surface is being cleaned and a wire is being flexed, angle $\beta$ tends to increase; angle $\chi$ tends to decrease, and surface 150 tends to engage inner surface 30 of resilient inner cylinder 26 more firmly.

In the prior art, the wires had to be pushed from the inside of the drum towards the outside because the wires were U-shaped staples. This required that the staple be aligned with two holes which was tedious and somewhat difficult since wire W is a single wire, rather than a two-legged staple, the problem of aligning two legs with two holes is eliminated. Further, in the prior art, the minimum inside diameter of the drum was limited to the length of the legs of the staple, which was a minimum diameter of about three and three-quarters inches.

The manufacture of the present invention provides a significant advantage over that of the prior. In the prior art the wires were bent into a U-shape, which formed a staple. The legs of the staple were then bent twice. This required two manufacturing steps; one to bend the U and a second to twice bend the legs of the staple. In contrast, the wire of the present invention can be bent in one manufacturing step, since the step to form a U-shaped bend is eliminated.

After a wire is inserted in each hole formed in the drum, retaining cylinder R, which is typically a metal cylinder, such as can be cut from a standard pipe, is pressed into position so that the end portion 130 of each wire is tightly sandwiched between outside surface 12 of retaining cylinder R and inside surface 30 of resilient inner cylinder 26. Cleaning apparatus 10 is now ready for assembly on shaft S.

Cleaning apparatus 10 is placed over an end of the shaft and bolts B are threaded into tapped holes in the end of the shaft, thus fastening cleaning apparatus 10 to the shaft. The shaft is typically attached to a piece of fixed machinery as cleaning apparatus 10 is typically too heavy for a hand-held device, although the design is certainly applicable for smaller, hand-held tools. In its typical application, cleaning apparatus 10 is fasten to a fixed piece of machinery, which provides power for rotating the shaft, and the piece to be cleaned is brought into contact with the wires, either by moving the cleaning apparatus or by moving the piece. Alternatively, cleaning apparatus 10, a cutter, can be mounted on a mandrel that has a center hub, which fastens onto a CV (constant velocity) joint. The CV joint allows the cutter to rock back and forth on its axle, allowing it to conform to the surface being cleaned.

Another significant advantage that the present invention provides over the prior art is in the density of wires W on drive D. In the prior art the wire was bent into a U-shaped staple, and the "U" portion of the staple was referred to as a crown. As there was a practical limit as to how sharp the bend could be made in the crown, there was a minimum distance between the legs of the U-shaped staple. Because of support requirements and bending radius limitation of the wire, the distance between tips for each staple was three-quarters of an inch, which resulted in a three-quarter inch spacing of tips per row on a standard drum. Further, the hole pattern that was used on prior art drums did not provide for the tight spacing available with the present invention.

Consequently, on a standard drum, the prior art provided 36 rows and 14 tips per row for a total of 504 tips on the standard size drum. On a same size standard drum of the present invention, 48 rows and 22 tips per row are provided for a total of 1,056 tips on a standard drum. Cleaning rates are dependent on the number of tips that scrap the surface per unit time, and the number of tips on a standard drum has been increased from 504 to 1,056 with the present invention, an increase of about 110%. Since cleaning rates are dependent on number of tips that scrap the surface per unit of time, cleaning rates are thus increased by 110% with the present invention.

Cleaning rates are not only significantly improved, but also the surface is cleaned more uniformly because the tips of the wires are both more densely packed and are more stable. Tips or ends 122 of wires W are more densely packed because the hole pattern has been changed to provide holes more closely packed together and because single wires are used rather than two-legged staples. Tips on ends 122 of wire W are more stable because wires W are more firmly supported with the present invention than in the prior art.

In the prior art the only support for the wires was provided where the crown of the staples bore against the inner rubber cylinder, which had to resist the forces on the two tips of the staple. For a standard size drum the length of the crown between the two legs of the staple was about three-eighths of an inch. Thus, about three-eighths of an inch of rubber was available to resist the cutting action of both tips of the staple or about half amount of rubber per leg or tip. The inner rubber cylinder of the prior art drum thus incurred considerable wear, which limited the life of the drum. Further, as the rubber wore, the tips became loose and unstable which reduced both the effectiveness of the cleaning and the uniformity of it.

In contrast, the wire of the present invention for a standard size drum has a surface 150 engaged with inner surface 30 of resilient inner cylinder 28. Surface 150 is about three-fourths of an inch long, and thus about three-fourths of an inch of rubber or resilient inner cylinder 26 is available to support a single wire. Thus, a single wire of the present invention has about three-fourths of an inch of support as compared to a leg of a wire of the prior art having about three-sixteenths of an inch of support. Wire W has about four times as much support as a wire of the prior art. Thus, resilient inner cylinder 26 is much more able to resist abrasion and wear than was its counterpart in the prior art. Consequently, tips or ends 122 do not become loose nearly as readily as in the prior art, and consequently, cleaning production can be sustained at a high level.

Further, in the present invention end portion 130 of the wire W lies along the internal circumference of drum D. In contrast, the staples of the prior art had crowns that were aligned axially with the longitudinal axis of the drum. Circumferentially-arranged end portion 130 of wires W are better supported than were the axially-arranged crowns of the staples of the prior art.

A retaining cylinder was not used with the prior art cleaning apparatus. Consequently, the staple crowns rocked back and forth as the tips of the wires were engaged in a cleaning operation. The firmness and stability of the wires depended on the hardness of the rubber used in the drum and how worn it was. End portion 130 of the wires of the present invention, on the other hand, are retained firmly in place by retaining cylinder R and ends 122 are consequently held much more firmly in position than were the tips of the prior art.

Wires W of the present invention are thus held in a much more stable position than were the wires of the prior art. When the cleaning apparatus of the prior art was in operation, the prior art wires were not sufficiently supported laterally so that a tip of one wire moved laterally into the path made by the tip of a forwardly spaced wire, which caused grooves to be formed on the surface that was cleaned. Further, since the tips of the wires were not as densely packed in the prior art drum as compared to that of the present invention, the surface was not cleaned as uniformly. In the present invention, end portions 130 cannot move laterally because movement is restricted by adjacent wires passing through their respective holes, thus wire W cannot rotate within hole H, and thus, tip or end 122 is held in a stable position. This coupled with the higher density of tips or ends 122 provides much more uniform cleaning than could be achieved with the cleaning apparatus of the prior art.

Thus, the present invention provides a cleaning apparatus which is simpler to manufacture, since a manufacturing step is eliminated in making the wires, and more effective in cleaning a surface. The shape of wire W and the pattern of holes H allow a much denser packing of the wires and their tips. Wires W are firmly supported and are thus more stable which works in conjunction with the higher density of wires to provide a surface that is not only cleaned more efficiently but more uniformly. On a standard drum, the present invention has about 110% more cleaning tips which allows cleaning rates to be about 110% higher. For all these reasons, the present invention provides significant advantages over the prior art.

The foregoing disclosure and description of the invention are illustrative and explanatory thereof, and various changes in the details of the illustrated apparatus and the construction and method of operation may be made without departing from the scope and spirit of the invention.

What is claimed is:

1. A cleaning apparatus, comprising:

a cylindrical drum having an inside, an outside and a plurality of openings therethrough, wherein the drum is substantially rigid, a plurality of wires having ends, each wire extending through one of said openings for engaging a surface to be cleaned, one end of each wire being inside the drum and another end being outside the drum; and a resilient body having said substantially rigid drum embedded therein.

2. A cleaning apparatus, comprising:

a cylindrical drum having a plurality of openings therethrough, and a plurality of wires, each wire extending through one of said openings for engaging a surface to be cleaned, wherein each wire has a first portion inside the drum, a second portion extending substantially radially from said first portion, a third portion disposed substantially circumferentially, and a fourth portion extending substantially radially from the cylindrical drum.

3. The apparatus of claim 2, wherein the arrangement of the series of openings is in rows which are helically disposed.

4. The apparatus of claim 2, further comprising a retaining cylinder engaging said first portions of said wires.

5. The apparatus of claim 2, wherein each wire has inner and outer ends, the first portion being proximate to the inner end, the fourth portion being proximate to the outer end, wherein an inner bend in the wire provides a transition between the first and second portions, a middle bend provides a transition between the second and third portions, and an outer bend provides a transition between the third and fourth portions, and wherein the inner and outer bends are in a same direction and the middle bend is in an opposite direction.

6. The apparatus of claim 5, wherein the inner bend transitions the wire from inside the drum into the opening and the middle bend transitions the wire from the opening to the outside of the drum.

7. The apparatus of claim 2, wherein the openings form a pattern of parallel spiral lines around the drum, straight axial lines and straight circumferential lines, wherein axially adjacent openings are spaced apart by the width of at least two openings.

8. The apparatus of claim 2, wherein the openings are arranged in circumferential columns and axial rows, adjacent openings in a row being spaced apart by an axial space, an opening in an adjacent row falling within the axial space and an opening in a row once removed falling within the axial space.

9. The apparatus of claim 2, wherein the drum is substantially rigid, further comprising a resilient body having said substantially rigid drum embedded therein.

10. The apparatus of claim 9, wherein the wire has three bends.

11. An abrasive cleaning apparatus, comprising:

a cylindrical drum having a plurality of holes and an inside edge; and a single wire engaged with each hole, the plurality of holes having a pattern, the pattern including a beginning row, a middle row and an ending row, the middle row being between the beginning and end rows, each row having an edge hole, the edge hole of each row being closer to the inside edge of the drum than any other hole in that row, the edge hole of the beginning row being adjacent to the inside edge of the drum, the edge hole of the middle row being spaced from the inside edge of the drum by at least the diameter of the edge hole of the beginning row, and the edge hole of the ending row being spaced from the inside edge of the drum by at least twice the diameter of the edge hole of the beginning row.

12. The apparatus of claim 11, wherein the rows are arranged axially and the beginning row has a second hole adjacent to the edge hole of the beginning row, there being an axial space between the edge hole and the second hole of the beginning row, wherein the edge hole of the middle row and the edge hole of the ending row are aligned within the axial space between the edge hole and the second hole of the beginning row.

13. The apparatus of claim 11, wherein a line drawn from the edge hole of the beginning row, through the edge hole of the middle row, through the edge hole of the ending row and continuing in a relatively straight line through each next subsequent hole will form a spiral around the drum.

14. The apparatus of claim 11, wherein the drum has an interior chamber and the wire has first and second ends, the wire having a first portion adjacent the first end inside the interior chamber of the drum, the first portion of the wire being aligned circumferentially with the drum, the wire having a second portion passing through the hole in the drum, the wire having a remaining portion outside the drum, the remaining portion including the second end.

15. The apparatus of claim 14, wherein the remaining portion outside the drum includes a portion bending circumferentially in an opposite direction as the first portion, and the second end extends away from the drum.

16. An abrasive cleaning apparatus, comprising:

an integral drum having a core drum, an inner drum, an outer drum and a plurality of holes, the holes being arranged in columns about the circumference of the integral drum and in rows spaced radially about the integral drum, the core drum having an inner surface and an outer surface;

the inner drum having substantially the same shape and configuration as the core drum, the inner drum having an inner surface and an outer surface, the outer surface of the inner drum engaging the inner surface of the core drum;

the outer drum having substantially the same shape and configuration as the core drum, the outer drum having an inner surface and an outer surface, the inner surface of the outer drum engaging the outer surface of the core drum; and a plurality of wires, wherein a wire is engaged in and passing through a hole, the wire having a first portion engaging the inner drum, the first portion of the wire being aligned circumferentially with the inner drum and being proximate to the inner surface of the inner drum, the wire having a second portion passing through the hole, the wire having a third portion outside the outer surface of the outer drum, the third portion of the wire being aligned circumferentially, the third portion extending in a direction opposite to the first portion, and a fourth portion of the wire extending radially away from the outer drum.

17. The apparatus of claim 16, further comprising a retaining cylinder engaged with said plurality of wires, the first portion of each wire being sandwiched between the retaining cylinder and the inner surface of the inner drum.

18. The apparatus of claim 16, wherein the lateral movement of the first portion of a first wire is restricted by contact with the first portion of a second wire so that rotational movement of the first wire in the hole in which it is engaged is restricted.

19. A rotary scraper, comprising:

a drum having an outside surface; and a plurality of wires engaged with the drum, each wire having first and second ends, the first end of each wire being within the drum and the second end of the wire being outside of the outside surface, wherein each wire has a first portion terminating in the first end and a second portion terminating in the second end, and wherein the first portion extends circumferentially with respect to the drum and the second portion extends radially with respect to the drum.

* * * * *